United States Patent [19]

Matsuoka et al.

[11] Patent Number: 4,959,137

[45] Date of Patent: Sep. 25, 1990

[54] ELECTROCOATING SYSTEM WITH MULTISTAGE VOLTAGE APPLICATION TO PREVENT ELECTRODE COATING

[75] Inventors: Isamu Matsuoka; Noboru Sato, both of Mie, Japan

[73] Assignee: Honda Giken Kogyo Kabushiki Kaisha, Tokyo, Japan

[21] Appl. No.: 342,522

[22] Filed: Apr. 24, 1989

[30] Foreign Application Priority Data

Jan. 24, 1989 [JP] Japan ..... 1-14380

[51] Int. Cl.[5] ..... C25D 13/22

[52] U.S. Cl. ..... 204/299 EC; 204/300 R; 204/300 EC; 204/180.2; 361/225; 361/226; 361/227; 361/228; 361/229; 219/69.13

[58] Field of Search ..... 204/299 EC, 300 R, 300 EC; 361/225, 226, 227, 228, 229; 219/69.13

[56] References Cited

U.S. PATENT DOCUMENTS 3,355,375 11/1967 Brewer et al. ..... 204/300 R
3,728,242 4/1973 Loop et al. ..... 204/300 R
4,486,284 12/1984 Mori et al. ..... 204/300 EC

FOREIGN PATENT DOCUMENTS 302978 12/1987 European Pat. Off. .
62-156300 7/1987 Japan .

*Primary Examiner*—John F. Niebling
*Assistant Examiner*—David G. Ryser
*Attorney, Agent, or Firm*—Irving M. Weiner; Joseph P. Carrier; Pamela S. Burt

[57] ABSTRACT

An electrocoating system with multistage voltage application includes an electrocoating bath filled with a coating material and having inlet and outlet sides, a feeding arrangement for supporting and moving an object to be immersed and coated in the electrocoating bath so that the object will serve as an electrode, electrode means including a plurality of voltage-application stages arranged successively from the inlet to outlet sides of the electrocoating bath, each of the stages having at least one electrode arranged along a path of travel of an object as moved by the feeding arrangement, power supply means for applying different independently variable voltages through the stages, respectively, and diode means for preventing the electrodes of the stages from being electrocoated with the coating material, the diode means including diodes which are forward-connected respectively between the power supply means and the electrodes of the stages. Therefore, any undesirable electric currents which would otherwise electrocoat the electrodes of the stages are prevented from flowing by the diodes.

6 Claims, 4 Drawing Sheets

ELECTROCOATING SYSTEM WITH MULTISTAGE VOLTAGE APPLICATION TO PREVENT ELECTRODE COATING

BACKGROUND OF THE INVENTION

1. Field of the Invention

The present invention relates to an electrocoating system for applying an electrodeposited coating layer to an object under sequentially applied different voltages, and more particularly to such an electrocoating system having means for preventing a coating from being deposited on electrodes themselves.

2. Prior Art

Electrocoating processes employing a cationic coating material, particularly for electrocoating automotive bodies, have heretofore applied a high voltage during electrocoating cycles to produce a coating of large thickness in order to make the coating resistant to rust.

The conventional electrocoating process in which a high voltage is applied to an object such as an automotive body is however disadvantageous in that the electrodeposited coating suffers various surface irregularities such as blisters, pimples, pinholes, and rivels. These coating problems are apt to occur on a steel plate composed of multiple constituents, especially on a surface-treated steel plate used for increased rust prevention.

One electrocoating system for preventing the formation of such irregular coating surfaces is disclosed in Japanese Laid-Open Patent Publication No. 58-93894, for example. According to the disclosed electrocoating system, a lower voltage is applied during an initial stage of coating formation on an object, and thereafter a higher voltage is applied during a subsequent coating stage.

The prior electrocoating system is shown in FIG. 4 of the accompanying drawings. The system includes a first-stage electrode 102 and second-stage electrodes 103*a*, 103*b* disposed in an electrocoating bath 101 and arranged successively from inlet to outlet sides of the bath 101. A voltage V1 applied to the first-stage electrode 102 is selected to be lower than a voltage V2 applied to the second-stage electrodes 103*a*, 103*b*.

The voltages V1, V2 are produced by rectifying voltages from a three-phase AC power supply 104 with rectifying circuits 105*a*, 105*b* comprising thyristors or the like. The different voltages V1, V2 are generated by controlling the firing phase of the thyristors.

The rectifying circuits 105*a*, 105*b* have negative terminals connected respectively to bus bars 106*a*, 106*b*. An object 107 to be coated such as an automotive body is held in slidable contact with the bus bars 106*a*, 106*b* through a current collector 108. The bus bars 106*a*, 106*b* can be electrically connected to each other by means of a switch 109.

The bath 101 is filled with a coating material 110 and grounded. The bus bar 106*b* which applies the higher voltage is also connected to ground. The object 107 is moved in the bath 101 in the direction indicated by the arrow A.

As shown in FIG. 5, there is a potential difference ΔV1 between the voltage V1 applied to the first-stage electrode 102 and the voltage V2 applied to the second-stage electrodes 103*a*, 103*b* (V1<V2). Therefore, an electric current flows from the second-stage electrodes 103*a*, 103*b* toward the first-stage electrode 102, which itself is gradually electrocoated.

When the first-stage electrode 102 is electrocoated, it can no longer serve as an electrode since the electrodeposited coating thereon is an electrical insulator. The coating material is then electrodeposited on the object 107 only by the second-stage electrodes 103*a*, 103*b*. The electric current which flows from only the second-stage electrodes 103*a*, 103*b* is so small that the thickness of the electrodeposited coating may be small or suffer surface irregularities as described above.

FIG. 5 shows potentials of the electrodes when the switch 109 is open, or rendered nonconductive. The potential difference ΔVI between the first-stage electrode 102 and the second-stage electrodes 103*a*, 103*b* is equal to the difference between the voltage V2 applied to the second-stage electrodes 103*a*, 103*b* and the voltage V1 applied to the first-stage electrode 102. The electric current based on the voltage difference flows into the electrode plate 102 to electrodeposit the coating material thereon.

When the object 107 moves from the bus bar 106*a* to the bus bar 106*b*, the switch 109 is turned on or closed to keep the bus bars 106*a*, 106*b* at the same potential. If there were potential difference between the bus bars 106*a*, 106*b* at this time, when the bus bars 106*a*, 106*b* are electrically connected by the current collector 108, a spark discharge would be produced, damaging the current collector 108 and the bus bars 106*a*, 106*b*. When the switch 109 is turned on, there is developed a potential difference ΔV2 (see FIG. 6) between the first-stage electrode 102 and the second-stage electrodes 103*a*, 103*b*, the potential difference ΔV2 being the difference between the voltages applied to the electrodes 102 and 103*a*, 103*b*. The electrode 102 is thus electrocoated with more coating material under the increased potential difference ΔV2.

In order to eliminate the above drawback, the applicant has proposed an electrocoating system as shown in FIG. 7 in which a diode 111 is forward-connected between first-stage electrodes 102*a* 102*b* and the positive terminal of a first-stage power supply 105A to eliminate a current loop from a second-stage power supply 105B to second-stage electrodes 103*a*, 103*b* to a coating material 110 to the first-stage electrodes 102*a*, 102*b* to the first-stage power supply V1 (see Japanese Laid-Open Patent Publication No. 62-156300).

The diode 111 prevents any electric current from flowing from the higher-voltage power supply V2 to the lower-voltage power supply V1, so that the coating material which would otherwise be deposited on the first-stage electrodes 102*a*, 102*b* is largely reduced.

With the plural electrodes 102*a*, 102*b* employed as shown in FIG. 7, however, an electric current flows from the second-stage electrodes 103*a*, 103*b* to the first-stage electrode 102*b* to the first-stage electrode 102*a* to a bus bar 106*a*, thus electrodepositing the coating material on the first-stage electrode 102*a* or 102*b* to form an insulative coating thereon.

This problem will be described in detail with reference to the equivalent circuit shown in FIG. 8. The power supply 105A applies a voltage V1 to the first-stage electrodes 102*a*, 102*b*. The power supply 105B applies a voltage V2 to the second-stage electrodes 103*a*, 103*b*. The electrodes 102*a*, 102*b*, 103*a*, 103*b* have electric resistances R1, R2, R3, R4, respectively, and the object 107 has an electric resistance R*b*. There are electric resistances r1, r2, r3, r4 presented by the coating material 110 between the first-stage electrode 102*a* and the object 107, between the first-stage electrode 102*b* and the object 107, between the second-stage electrode 103*a* and the object 107, and between the second-stage electrode 103*b* and the object 107, respectively. There are also electric resistances r13, r23 presented by the coating material 110 between the second-stage electrode 103*a*, which is closer to the first-stage electrodes 102*a*, 102*b*, and the first-stage electrode 102*a* and between the second-stage electrode 103*a* and the first-stage electrode 102*b*, respectively.

When a switch 109 shown in FIG. 7 is turned on to connect the negative terminals of the power supplies 105A, 105B to each other, or the object 107 is electrically coupled to the second-stage bus bar 106*b*, a current loop is formed from the positive terminal of the power supply 105B successively through the resistances R3, r13, R1, R2, r2, R*b* to the negative terminal of the power supply 105B, or from the positive terminal of the power supply 105B successively through the resistances R3, r23, R2, R1, r1, R*b* to the negative terminal of the power supply 105B. Therefore, the first-stage electrode 102*a* or 102*b* is electrocoated with the coating material.

SUMMARY OF THE INVENTION

In view of the aforesaid shortcomings of the conventional electrocoating systems, it is an object of the present invention to provide an electrocoating system having a plurality of stages of electrodes for applying different voltages to electrodeposit a coating on an object, the electrocoating system being capable of preventing an unnecessary electric current from flowing between such multistage electrodes or from flowing from a higher-voltage electrode to a lower-voltage electrode in one stage, so that the electrodes themselves will be prevented from being electrocoated with a coating material.

According to the present invention, there is provided an electrocoating system with multistage voltage application, comprising an electrocoating bath filled with a coating material and having inlet and outlet sides, feed means for supporting and moving an object to be immersed and coated in the electrocoating bath so that the object will function as an electrode, electrode means including a plurality of voltage-aplication stages arranged successively from the inlet to outlet sides of the electrocoating bath, each stage having at least one electrode arranged along a path of travel of an object as moved by the feed means power supply means for applying different independently variable voltages through the stages, respectively, and diode means, the second for preventing the electrodes of the stages from being electrocoated with the coating material, the diode means including diodes which are forward-connected respectively between the power supply means and the electrodes of the stages.

According to the present invention, there is also provided such an electrocoating system with multistage voltage application wherein the power supply means is adapted to apply successively higher voltages to the stages arranged successively from the inlet to outlet sides of the electrocoating bath, and the diode means includes diodes which are forward-connected respectively between the power supply means and the electrodes of the stages ranging from a first stage positioned at the inlet side of the bath to a stage preceding a final stage positioned at the outlet side of the bath.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 6 is a diagram showing the potentials of electrodes in the system of FIG. 4 when the switch is turned on;

DETAILED DESCRIPTION OF THE PREFERRED EMBODIMENTS

Figure 1:
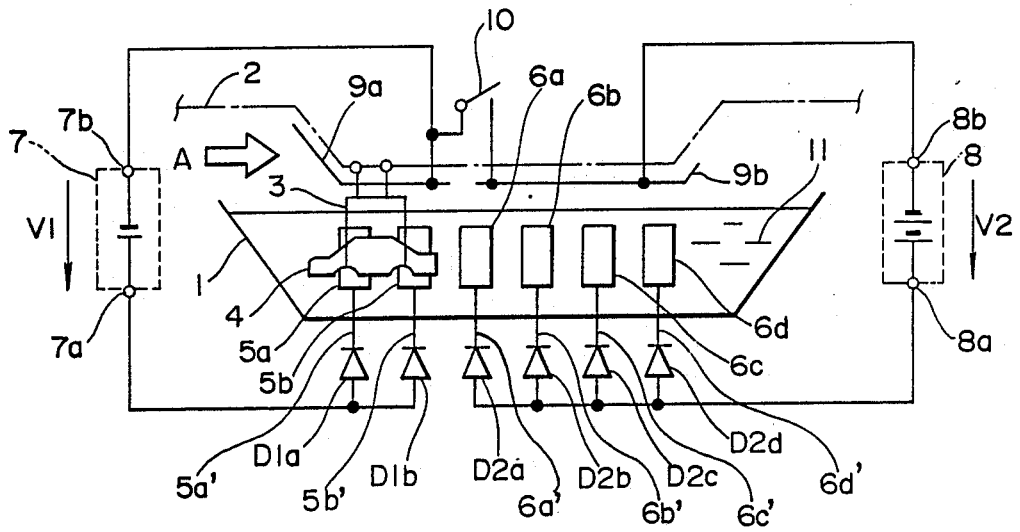
FIG. 1 is a schematic view of an electrocoating system with two-stage voltage application according to a first embodiment of the present invention.

FIG. 1 schematically shows an electrocoating system with two-stage voltage application in accordance with a first embodiment of the present invention.

An object 4 to be coated such as an automotive body or the like is electrocoated with a coating material or solution 11 while it is being immersed and moved in an electrocoating bath 11 which is filled with the coating material. A feed conveyor 2 for moving the object 4 through the electrocoating bath 1 is placed above the electrocoating bath 1. The feed conveyor 2 has an electrically conductive movable hanger 3 on which the object 4 is supported while being moved in the electrocoating bath 1.

The electrocoating bath 1 houses therein firststage electrodes (electrode plates) 5*a*, 5*b* or electrodes 5*a*, 5*b* of a first voltage-application stage and second-stage electrodes (electrode plates) 6*a*, 6*b*, 6*c*, 6*d* or electrodes 6*a*, 6*b*, 6*c*, 6*d* of a second voltage-application stage which are successively positioned from an inlet side toward an outlet side (i.e., in a rightward direction) of the bath 1 and immersed in the coating material 11. The first-stage electrodes 5*a*, 5*b* are connected respectively to the cathodes of diodes D1*a*, D1*b* through respective lines 5*a*', 5*b*', and the anodes of the diodes D1*a*, D1*b* are connected to the positive terminal 7*a* of a DC power supply 7 which serves as a power supply means for the first-stage electrodes 5*a*, 5*b*. Likewise, the second-stage electrodes 6*a*, 6*b*, 6*c*, 6*d* are connected respectively to the cathodes of diodes D2*a*, D2*b*, D2*c*, D2*d* through respective lines 6*a*', 6*b*', 6*c*', 6*d*', and the anodes of the diodes D2*a*, D2*b*, D2*c*, D2*d* are coupled to the positive terminal 8*a* of a DC power supply 8 which serve as a power supply means for the second-stage electrodes 6*a*, 6*b*, 6*c*, 6*d*. Therefore, the diodes D1*a*, D1*b* and D2*a*, D2*b*, D2*c*, D2*d* are forward-connected between the corresponding electrodes and power supplies.

An electrically conductive current collector rail assembly 9*a*, 9*b* is disposed above the electrocoating bath 1 and extends parallel to the feed conveyor 2. The current collector rail assembly 9a, 9b comprises a first current collector rail 9a extending through a zone in which the first-stage electrodes 5a, 5b are disposed, and a second current collector 9b extending through a zone in which the second-stage electrodes 6a through 6d are disposed. The first-stage DC power supply 7 has its negative terminal 7b connected to the first current collector rail 9a, whereas the second-stage DC power supply 8 has its negative terminal 8b connected to the second current collector rail 9b.

The hanger 3 is moved in the direction indicated by the arrow A while it is slidably held in contact with the current collector rails 9a, 9b, one at a time. Therefore, the object 4 is electrically connected to the current collector rails 9a, 9b through the hanger 3. As can be understood from FIG. 1, a positive potential is developed on the electrodes in the coating material 11 and a negative potential is developed on the object 4.

A selective connector or switch 10 is coupled as a selective connector means between the first and second current collector rails 9a, 9b. The current collector rails 9a, 9b can be electrically connected to each other by turning on or closing the switch 10.

According to the illustrated embodiment, the DC power supply 7 has an output voltage V1 and the DC power supply 8 has an output voltage V2 which is higher than the output voltage V1 (V1<V2). The coating material 11 filled in the electrocoating bath 1 is a cationic coating material.

In operation, a maximum voltage is applied to the second-stage electrodes 6a through 6d. The diodes D2*a* through D2*d* which are forward-connected to the electrodes 6a through 6d, respectively, serve to prevent the electrodes 6a through 6d from being electrocoated when the output voltage V2 of the DC power supply 8 drops for some reasons. The diodes D2*a* through D2*d* may however be dispensed with.

Operation of the electrocoating system shown in FIG. 1 will be described with reference to the equivalent circuit illustrated in FIG. 2.

Figure 2:
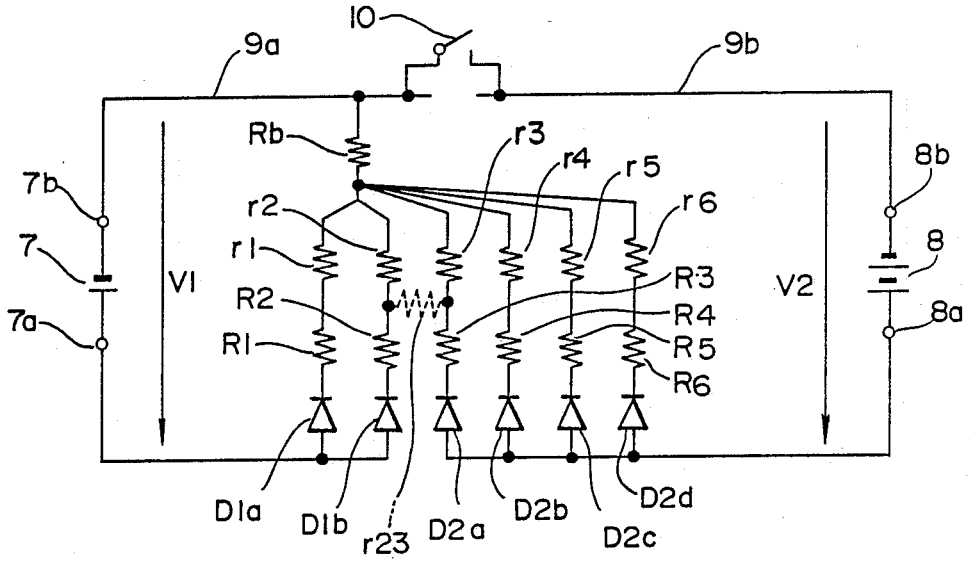
FIG. 2 is a circuit diagram of an equivalent circuit of the electrocoating system shown in FIG. 1.

In FIG. 2, the DC power supply 7 applies a voltage to the object 4 through the first-stage electrodes 5a, 5b, the DC power supply 8 applies a voltage V2 to the object 4 through the second stage electrodes 6a through 6d, the first- and second-stage electrodes 5a, 5b, 6a through 6d have respective electric resistances R1 through R6, and the object 4 has an electric resistance R*b*. An electric resistance r1 is developed by the coating material 11 between the first-stage electrode 5a and the object 4, an electric resistance r2 is developed by the coating material 11 between the other first-stage electrode 5b and the object 4, and electric resistances r3 through r6 are developed by the coating material 11 between the second-stage electrodes 6a through 6d and the object 4.

As shown in FIG. 1, the object 4 supported by the hanger 3 starts to be electrocoated when it is fed in the direction indicated by the arrow A into the electrocoating bath 1 by the feed conveyor 2. More specifically, the object 4 immersed in the coating material 11 in the bath 1 is moved along the first-stage electrodes 5a, 5b by the feed conveyor 2, during which time the hanger 3 is electrically connected to the first current collector rail 9a. An electric current flows from the positive terminal 7a of the first-stage DC power supply 7 through the diode D1*a*, the resistances R1, r1, R*b*, and the current collector rail 9a to the negative terminal 7b of the DC power supply 7, or from the positive terminal 7a of the first-stage DC power supply 7 through the diode D1*b*, the resistances R2, r2, R*b*, and the current collector rail 9a to the negative terminal 7b of the DC power supply 7, thereby electrocoating the object 4.

As the object 4 approaches the second current collector 9b following the first current collector 9a, the object 4 is positionally detected by a position detector such as a limit switch or a photoelectric detector, whereupon the swtich 10 is turned on. When the object 4 supported by the hanger 3 is completely transferred to the current collector rail 9b as detected by another position detector such as a limit switch or a photoelectric detector, the switch 10 is turned off.

When the switch 10 is turned on, the negative terminals 7b, 8b of the first- and second-stage DC power supplies 7, 8 are connected to each other. Since the first-stage electrodes 5a, 5b are connected to the DC power supply 7 through the respective forward-connected diodes D1*a*, D1*b*, however, no electric current flows from the second-stage electrode 6a, which is positioned adjacent to the first-stage electrode 5b and connected to the DC power supply 8 higher in potential than the DC power supply 7, to the first-stage electrode 5b based on the potential difference (V2−V1) between the DC power supplies 7, 8. Moreover, assuming that a resistance r23 is developed by the coating material 11 between the electrodes 5b, 6a, any current loop from the positive terminal 8a of the DC power supply 8 through the diode D2*a*, the resistances R3, r23, R2, R1, r1, R*b*, and the current collector rail 9b to the negative terminal 8b of the DC power supply 8, is prevented from being formed because of the diode D1*b* that is forward-connected to the electrode 5b. Likewise, the diode D1*a* forward-connected to the electrode 5a prevents any current loop from being formed from the positive terminal 8a of the DC power supply 8 through the diode D2*a*, the resistance R3, the resistance developed by the coating material 11 between the electrodes 5a, 6a, the resistances R1, R2, r2, R*b*, and the current collector rail 9b to the negative terminal 8b of the DC power supply 8. Consequently, the first-stage electrodes 5a, 5b are not electrocoated.

When the switch 10 is turned off upon transfer of the object 4 onto the current collector rail 9b, the voltage V2 higher than the voltage V1 is applied by the second-stage DC power supply 8 to the object 4 which now travels along the second-stage electrodes 6a through 6d. An electric current flows from the diodes D2*a*~D2*d* through the resistances R3~R6, the resistances r3~r6, the resistance R*b* to the current collector rail 9b to electrocoat the object 4 under the voltage V2.

Figure 3:
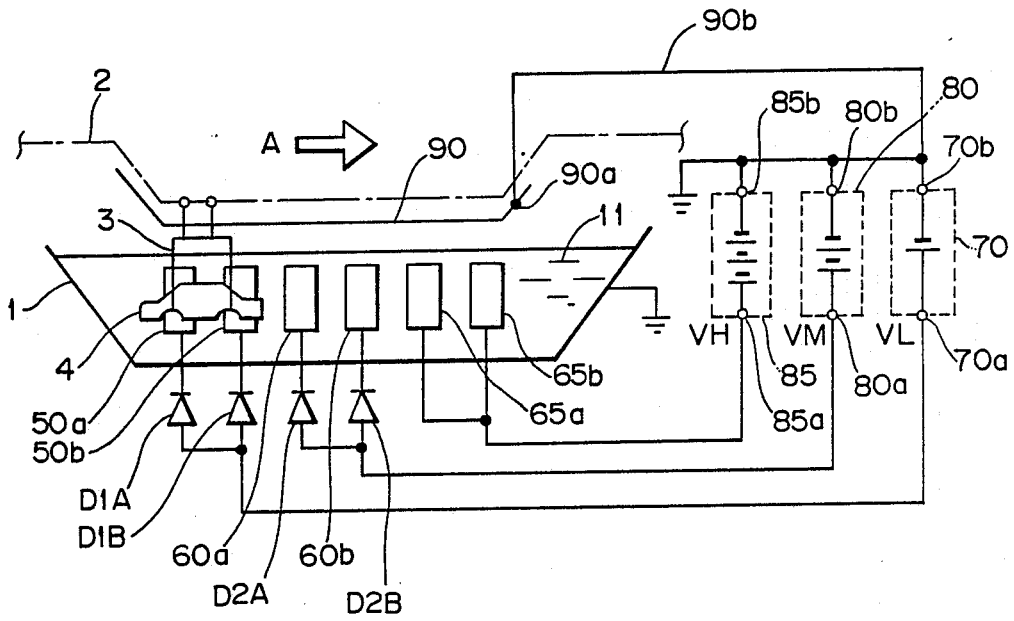
FIG. 3 is a schematic view of an electrocoating system with two-stage voltage application according to a second embodiment of the present invention.
Figure 5:
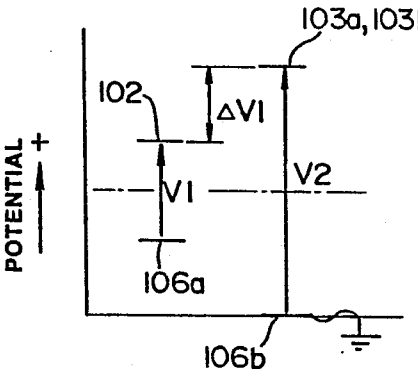
FIG. 5 PRIOR ART
FIG. 5 is a diagram showing the potentials of electrodes in the system of FIG. 4 when a switch is turned off.
Figure 6:
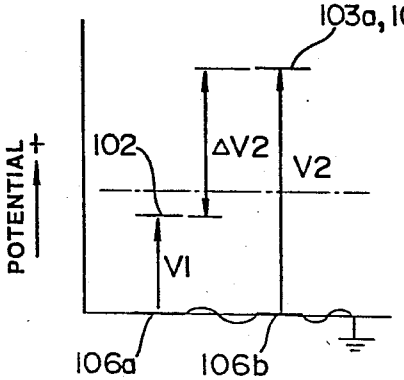
FIG. 6 PRIOR ART
Figure 4:
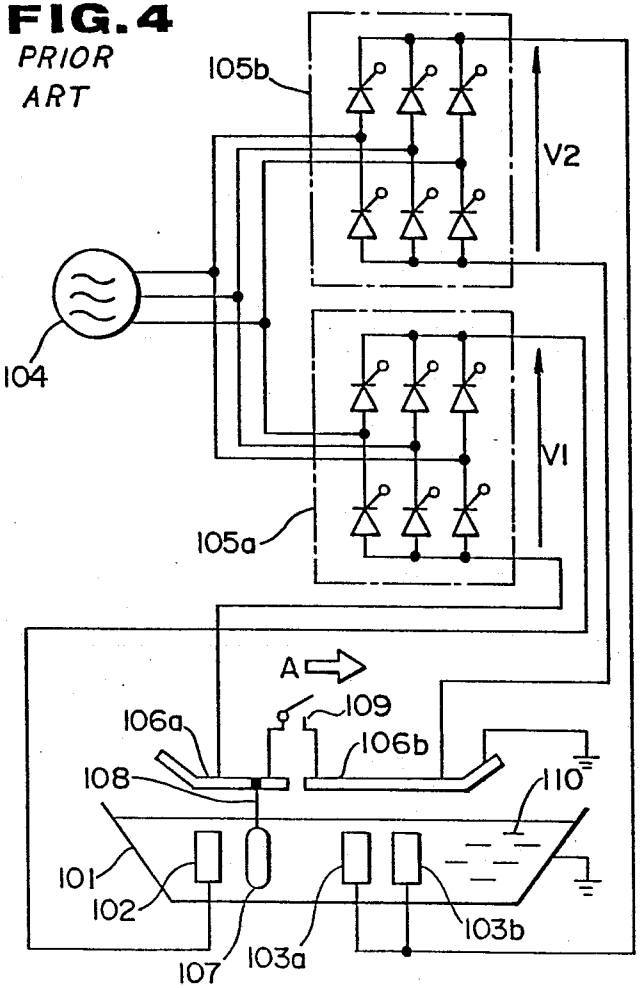
FIG. 4 PRIOR ART
FIG. 4 is a schematic view of a conventional electrocoating system with two-stage voltage application.
Figure 7:
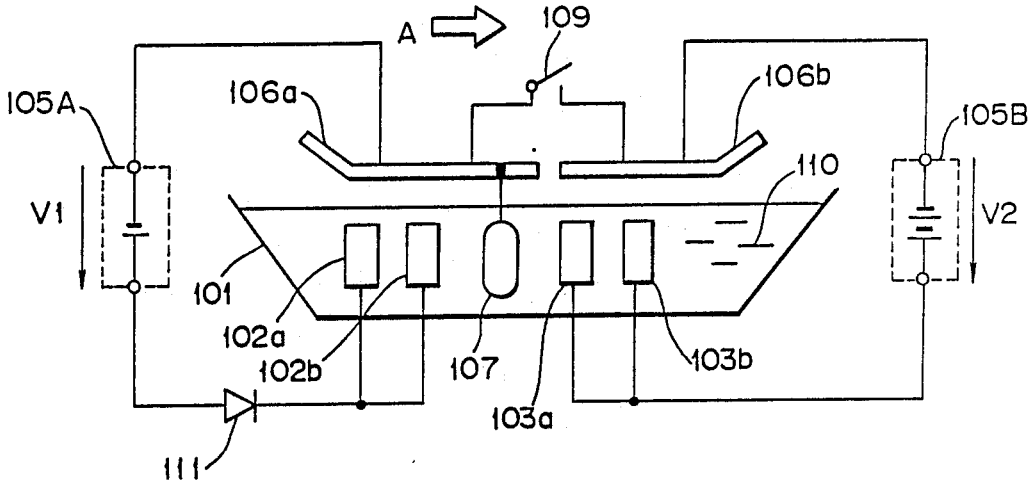
FIG. 7 PRIOR ART
FIG. 7 is a schematic view of another conventional electrocoating system with two-stage voltage application, which is an improvement over the electrocoating system illustrated in FIG. 4.
Figure 8:
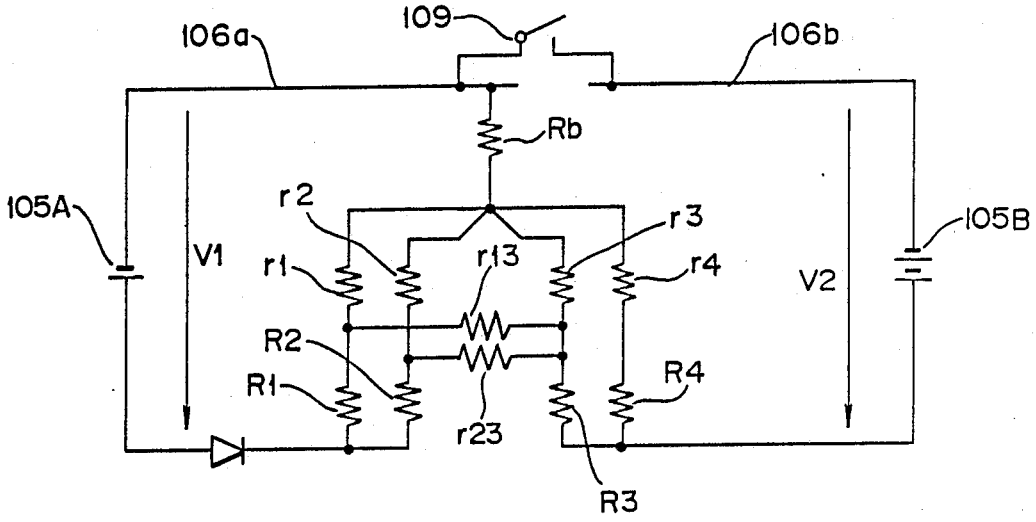
FIG. 8 PRIOR ART
FIG. 8 is a circuit diagram of an equivalent circuit of the electrocoating system shown in FIG. 7.

FIG. 3 schematically shows an electrocoating system with three-stage voltage application according to a second embodiment of the present invention.

An electrocoating bath 1 houses therein first-stage electrodes (electrode plates) 50a, 50b or electrodes 50a, 50b of a first voltage-application stage, second-stage electrodes (electrode plates) 60a, 60b or electrodes 60a, 60b of a second voltage-application stage, and third-stage electrodes (electrode plates) 65a, 65b or electrodes 65a, 65b of a third voltage-application stage which are successively positioned from an inlet side toward an outlet side (i.e., in a rightward direction) of the bath 1. The first-stage electrodes 50a, 50b are connected respectively to the cathodes of diodes D1A, D1B, and the anodes of the diodes D1A, D1B are connected to the positive terminal 70a of a first-stage DC power supply 70. Likewise, the second-stage electrodes 60a, 60b are connected respectively to the cathodes of diodes D2A, D2B, and the anodes of the diodes D2A, D2B are coupled to the positive terminal 80*a* of a second-stage DC power supply 80. Therefore, the diodes D1A, D1B and D2A, D2B are forward-connected between the corresponding first- and second-stage electrodes and power supplies. The positive terminal 85*a* of a third-stage DC power supply 85 is connected directly (without the intermediary of diodes) to the third-stage electrodes 65*a*, 65*b* to which a maximum voltage will be applied. However, diodes may be forward-connected between the third-stage electrodes 65*a*, 65*b* and the positive terminal 85*a* of the third-stage DC power supply 85.

A single current collector rail 90 extends parallel to the feed conveyor 2 and has an end 90*a*, near the outlet side of the bath 1, connected to one end of a connector line 90*b* the other end of which is coupled to the negative terminals 70*b*, 80*b*, 85*b* to the DC power supplies 70, 80, 85. An object 4 to be coated is supported by a hanger 3 which moves in slidable contact with the current collector rail 90. Therefore, a negative potential is developed on the object 4 during operation.

The negative terminals 70*b*, 80*b*, 85*b* of the DC power supplies 70, 80, 85 and the electrocoating bath 1 are grounded. The electrocoating bath 1 is filled with a cationic electrocoating material or solution 11. The DC power supplies 70, 80, 85 apply different voltages VL, VM, VH (VL <VM<VH).

The object 4 supported by the hanger 3 is delivered in the direction indicated by the arrow A into the bath 1 by the feed conveyor 2, whereupon the hanger 3 is electrically connected to the current collector rail 90. As the object 4 is progressively moved in the direction indicated by the arrow A, the lower voltage VL is first applied to the object 4 by the DC power suppy 70 through the first-stage electrodes 50*a*, 50*b*, then the medium voltage VM is applied to the object 4 by the DC power supply 80 through the second-stage electrodes 60*a*, 60*b*, and finally the higher voltage VH is applied to the object 4 by the DC power supply 85 through the third-stage electrodes 65*a*, 65*b*, thereby electrocoating the object 4 with the coating material 11.

The electrodes 50*a*, 50*b*, 60*a*, 60*b* which precede the final third-stage electrodes 65*a*, 65*b* are connected to the diodes D1A, D1B, D2A, D2B, respectively, for preventing electric currents from flowing from the higher potential VH to the medium or lower potential VM, VL or from the medium potential VM to the lower potential VL. Therefore, the electrodes 50*a*, 50*b*, 60*a*, 60*b* are prevented from being electrocoated with the coating material. Since no electric current flows between the electrodes to which the same voltage is applied (e.g., from the electrode 60*b* to the electrode 60*a* or from the electrode 50*b* to the electrode 50*a*), the electrodes 50*a*, 50*b*, 60*a*, 60*b*, 65*a*,65*b* are further prevented from being electrocoated.

Inasmuch as the negative terminals of the DC power supplies 70, 80, 85 are connected in common, only the single current collector rail 90 may be employed, and any switch, such as the switch 10 shown in FIG. 1, is not required.

The current collector rail 90 is connected to the negative terminals 70*b*, 80*b*, 85*b* of the power supplies 70, 80, 85 at the rail end 90*a* near the outlet side of the bath 1. This arrangement is advantageous in that any voltage drop produced along the current collector rail 90 by the current flowing during an electrocoating process is progressively lowered because the length of the current collector rail 90 along which such voltage drop is produced is progressively reduced as the object 4 travels toward the outlet side of the bath 1. Accordingly, as the object 4 moves on, the voltages actually impressed between the object 4 and the electrodes 50*a*, 50*b*, 60*a*, 60*b*, 65*a*, 65*b* are not lowered, and the object 4 can be well electrocoated with the coating material 11.

In the above two embodiments, the electrocoating systems with two- and three-stage voltage application have been described. However, the principles of the present invention are also applicable to electrocoating systems in which multistage voltages, more than the three-stage voltages, are applied to an object to be electrocoated. Electrodes used for electrocoating an object with a coating solution can be prevented from being electrocoated irrespective of the number of such electrodes in each voltage applying stage. The electrocoating bath in each of the embodiments shown in FIGS. 1 and 3 extend substantially linearly, but the invention is not limited to such an electrocoating bath configuration. Since electrodes connected to individual diodes may be successively arranged along a desired path of travel of an object to be electrocoated, the electrodes may be employed in any of electrocoating baths of various shapes such as a circular shape, an elliptical shape, and other shapes.

According to the conventional electrocoating system disclosed by the applicant, since a single diode is connected between the first-stage power supply and the first-stage electrodes, it cannot prevent; an electric current from flowing successively through (or between) the first-stage electrodes.

According to the present invention, however, diodes are forward-connected respectively to the electrodes in voltage applying stages, and voltages are applied through the diodes to these electrodes. Consequently, electric currents are prevented from flowing successively through the electrodes in each of the voltage applying stages, thus preventing an electric current from flowing from each subsequent electrode to the preceding electrode. As a result, each electrode or electrode plate is prevented from being electrocoated with a coating material, and hence an object can be electrocoated stably under preset conditions.

Since diodes are connected to at least electrodes which range from the first stage to a stage preceding the final stage, any electric current which would otherwise flow from an electrode of a higher potential to an adjacent electrode of a lower potential and then through a connector line and an electrode of a much lower potential to the object to be electrocoated is prevented by the reverse characteristics of the diodes. For the above reasons, the electrodes used for electrocoating the object in the coating material are prevented from being electrocoated with the coating material.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. An electrocoating system with multistage voltage application, comprising:

an electrocoating bath filled with a coating material and having inlet and outlet sides;

feed means for supporting and moving an object to be immersed and coated in said electrocoating bath so that the object will function as an electrode;

electrode means including a plurality of voltage-application stages arranged successively from said inlet to outlet sides of said electrocoating bath, each of said stages having at least one electrode arranged along a path of travel of an object as moved by said feed means;

power supply means for applying different, independently variable voltages through said stages, respectively; and diode means for preventing said electrodes of said stages from being electrocoated with the coating material, said diode means including a plurality of diodes which are forward-connected respectively between said power supply means and each of said electrodes of said stages other than those stages to which a maximum voltage is applied by said power supply means.

2. An electrocoating system with multistage voltage application, comprising:

an electrocoating bath filled with a coating material and having inlet and outlet sides;

feed means for supporting and moving an object to be immersed and coated in said electrocoating bath so that the object will function as an electrode;

electrode means including a plurality of voltage-application stages arranged successively from said inlet to outlet sides of said electrocoating bath, each of said stages having at least one electrode arranged along a path of travel of an object as moved by said feed means;

power supply means for applying different, independently variable voltages through said stages, respectively; and diode means for preventing said electrodes of said stages from being electrocoated with the coating material, said diode means including a plurality of diodes which are forward-connected respectively between said power supply means and each of said electrodes of said stages.

3. An electrocoating system according to claim 2, wherein said power supply means is adapted to apply successively higher voltages to said stages arranged successively from the inlet to outlet sides of said electrocoating bath.

4. An electrocoating system according to claim 3, wherein said diode means includes diodes which are forward-connected respectively between said power supply means and said electrodes of said stages ranging from a first stage positioned at the inlet side of said bath to a stage preceding a final stage positioned at the outlet side of said bath.

5. An electrocoating system according to claim 2, wherein said electrode means is composed of three distinctive voltage-application stages including a first stage, a middle stage and a final stage which are successively arranged along said path of travel.

6. An electrocoating system according to claim 2 wherein said electrode means is composed of two distinctive voltage-application stages including a first stage and a final stage which are successively arranged along said path of travel.

* * * * *

UNITED STATES PATENT AND TRADEMARK OFFICE

CERTIFICATE OF CORRECTION

PATENT NO. : 4,959,137

DATED : September 25, 1990

INVENTOR(S) : Matsuoka et al

It is certified that error appears in the above-identified patent and that said Letters Patent is hereby corrected as shown below:

Column 2, line 21, after "on" insert a comma; after "closed" insert a comma.

Column 3, line 43, change "voltage-aplication" to --voltage-application--;
line 47, after "means" insert a comma;
line 49 and 50, delete ", the second".

Column 4, line 61, change "serve" to --serves--.

Column 8, line 29, after "prevent" delete the semicolon.

Column 10, line 29 (Claim 6, line 1), after "2" insert a comma.

Signed and Sealed this

Twenty-fourth Day of December, 1991

*Attest:*

HARRY F. MANBECK, JR.

*Attesting Officer*

*Commissioner of Patents and Trademarks*